US006502951B2

(12) United States Patent
Marshall

(10) Patent No.: US 6,502,951 B2
(45) Date of Patent: Jan. 7, 2003

(54) LIGHTED AND CONTENT-ORGANIZING CARRYING CASE

(76) Inventor: Marilyn J. Marshall, 5757 Westheimer Rd. Ste 391, Houston, TX (US) 77057

( * ) Notice: Subject to any disclaimer, the term of this patent is extended or adjusted under 35 U.S.C. 154(b) by 0 days.

(21) Appl. No.: 09/727,419

(22) Filed: Dec. 1, 2000

(65) Prior Publication Data

US 2002/0067610 A1 Jun. 6, 2002

(51) Int. Cl.[7] ..... A45C 15/06
(52) U.S. Cl. ..... 362/156; 362/154
(58) Field of Search ..... 362/154, 155, 362/156, 184, 206, 253; 150/110, 117, 138, 145, 147, 150, 151

(56) References Cited

U.S. PATENT DOCUMENTS 2,003,130 A * 5/1935 Benjafield ..... 150/145
2,117,989 A * 5/1938 Ryan ..... 150/138
2,218,396 A 10/1940 Hallbauer
2,845,973 A * 8/1958 Strong ..... 150/110
4,954,934 A * 9/1990 Kidder et al. ..... 362/156
D315,830 S 4/1991 Roberts
D358,706 S 5/1995 Kopel
5,444,605 A 8/1995 Rivera
D380,087 S 6/1997 Roth
D380,609 S 7/1997 Formby
5,764,132 A * 6/1998 Hill ..... 362/156
5,911,262 A * 6/1999 Steinhart ..... 150/117
6,047,752 A * 4/2000 Southwick ..... 150/117

* cited by examiner

*Primary Examiner*—Y. My Quach-Lee

(57) ABSTRACT

A lighted and content-organizing carrying case for illuminating the main compartment and organizing the contents in the carrying case. The lighted and content-organizing carrying case includes a handbag assembly including a bag having walls, a main compartment and an opening into the main compartment, and also including a side compartment and a cover member being removably closed over the side compartment and a fastening member for closing the cover member over the side compartment, and further including a carrying strap having ends securely attached to the bag, and also including a fastener for closing the opening into the main compartment, and further including a plurality of pockets securely attached to the bag, and also including light-emitting assemblies removably attached to the bag.

17 Claims, 2 Drawing Sheets

LIGHTED AND CONTENT-ORGANIZING CARRYING CASE

BACKGROUND OF THE INVENTION

1. Field of the Invention

The present invention relates to a lighted and content-organizing carrying case and more particularly pertains to a new lighted and content-organizing carrying case for illuminating the main compartment and organizing the contents in the carrying case.

2. Description of the Prior Art

The use of a lighted and content-organizing carrying case is known in the prior art. More specifically, a lighted and content-organizing carrying case heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Pat. No. 5,444,605; U.S. Pat. No. Des. 380,087; U.S. Pat. No. Des. 315,830; U.S. Pat. No. Des. 380,609; U.S. Pat. No. Des. 358,706; and U.S. Pat. No. 2,218,396.

While these devices fulfill their respective, particular objectives and requirements, the aforementioned patents do not disclose a new lighted and content-organizing carrying case. The inventive device includes a handbag assembly including a bag having walls, a main compartment and an opening into the main compartment, and also including a side compartment and a cover member being removably closed over the side compartment and a fastening member for closing the cover member over the side compartment, and further including a carrying strap having ends securely attached to the bag, and also including a fastener for closing the opening into the main compartment, and further including a plurality of pockets securely attached to the bag, and also including light-emitting assemblies removably attached to the bag.

In these respects, the lighted and content-organizing carrying case according to the present invention substantially departs from the conventional concepts and designs of the prior art, and in so doing provides an apparatus primarily developed for the purpose of illuminating the main compartment and organizing the contents in the carrying case.

SUMMARY OF THE INVENTION

In view of the foregoing disadvantages inherent in the known types of lighted and content-organizing carrying case now present in the prior art, the present invention provides a new lighted and content-organizing carrying case construction wherein the same can be utilized for illuminating the main compartment and organizing the contents in the carrying case.

The general purpose of the present invention, which will be described subsequently in greater detail, is to provide a new lighted and content-organizing carrying case which has many of the advantages of the lighted and content-organizing carrying case mentioned heretofore and many novel features that result in a new lighted and content-organizing carrying case which is not anticipated, rendered obvious, suggested, or even implied by any of the prior art lighted and content-organizing carrying case, either alone or in any combination thereof.

To attain this, the present invention generally comprises a handbag assembly including a bag having walls, a main compartment and an opening into the main compartment, and also including a side compartment and a cover member being removably closed over the side compartment and a fastening member for closing the cover member over the side compartment, and further including a carrying strap having ends securely attached to the bag, and also including a fastener for closing the opening into the main compartment, and further including a plurality of pockets securely attached to the bag, and also including light-emitting assemblies removably attached to the bag.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new lighted and content-organizing carrying case which has many of the advantages of the lighted and content-organizing carrying case mentioned heretofore and many novel features that result in a new lighted and content-organizing carrying case which is not anticipated, rendered obvious, suggested, or even implied by any of the prior art lighted and content-organizing carrying case, either alone or in any combination thereof.

It is another object of the present invention to provide a new lighted and content-organizing carrying case which may be easily and efficiently manufactured and marketed.

It is a further object of the present invention to provide a new lighted and content-organizing carrying case which is of a durable and reliable construction.

An even further object of the present invention is to provide a new lighted and content-organizing carrying case which is susceptible of a low cost of manufacture with regard to both materials and labor, and which accordingly is then susceptible of low prices of sale to the consuming public, thereby making such lighted and content-organizing carrying case economically available to the buying public.

Still yet another object of the present invention is to provide a new lighted and content-organizing carrying case which provides in the apparatuses and methods of the prior art some of the advantages thereof, while simultaneously overcoming some of the disadvantages normally associated therewith.

Still another object of the present invention is to provide a new lighted and content-organizing carrying case for illuminating the main compartment and organizing the contents in the carrying case.

Yet another object of the present invention is to provide a new lighted and content-organizing carrying case which includes a handbag assembly including a bag having walls, a main compartment and an opening into the main compartment, and also including a side compartment and a cover member being removably closed over the side compartment and a fastening member for closing the cover member over the side compartment, and further including a carrying strap having ends securely attached to the bag, and also including a fastener for closing the opening into the main compartment, and further including a plurality of pockets securely attached to the bag, and also including light-emitting assemblies removably attached to the bag.

Still yet another object of the present invention is to provide a new lighted and content-organizing carrying case that allows the user to quickly locate the items needed inside the carrying case.

Even still another object of the present invention is to provide a new lighted and content-organizing carrying case that is easy and convenient to use.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
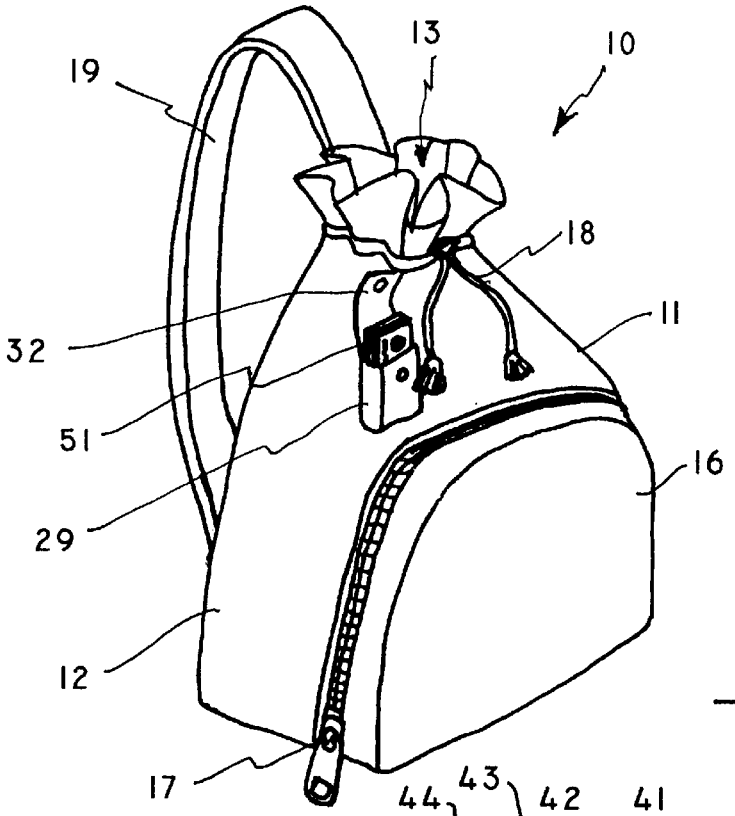
FIG. 1 is a perspective view of a new lighted and content-organizing carrying case according to the present invention.
Figure 2:
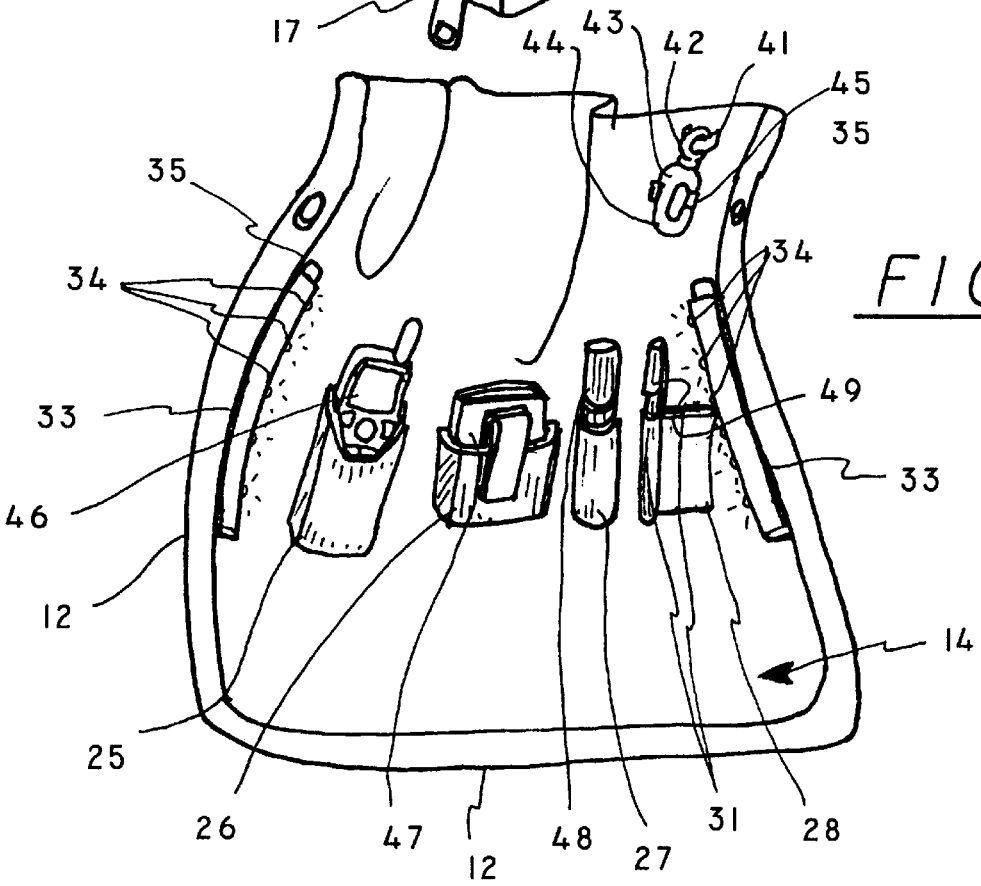
FIG. 2 is a cross-sectional view of the bag of the present invention.
Figure 5:
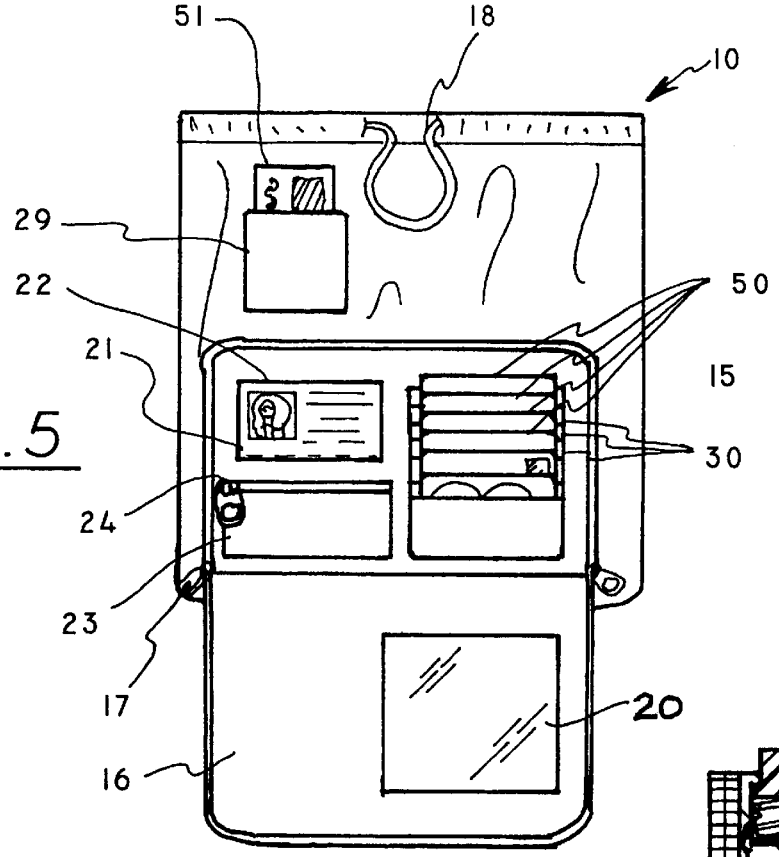
FIG. 5 is a side elevational view of the bag of the present invention with the cover member being opened to expose the side compartment.
Figure 3:
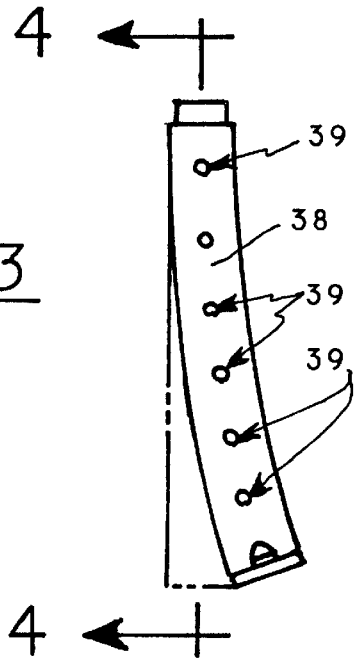
FIG. 3 is a detailed side elevational view of one of the light-emitting means of the present invention.
Figure 4:
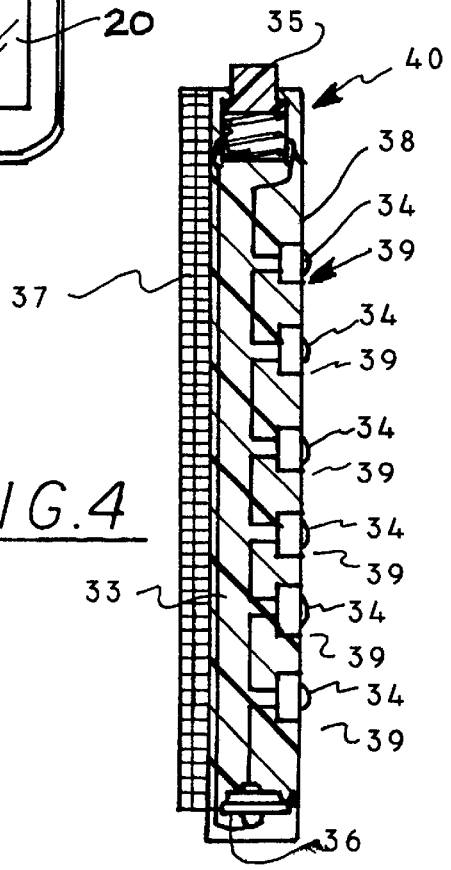
FIG. 4 is a cross-sectional view of one of the light-emitting holders of the present invention.

With reference now to the drawings, and in particular to FIGS. 1 through 5 thereof, a new lighted and content-organizing carrying case embodying the principles and concepts of the present invention and generally designated by the reference numeral 10 will be described.

As best illustrated in FIGS. 1 through 5, the lighted and content-organizing carrying case 10 generally comprises a handbag assembly including a bag 11 having walls 12, a main compartment 14 and an opening into the main compartment 13, and also including a side compartment 15 and a cover member 16 having an edge securely and conventionally attached to the bag 11 and being removably closed over the side compartment 15 and a fastening member 17 for closing the cover member 16 over the side compartment 15, and further including a carrying strap 19 having ends securely and conventionally attached to the bag 11, and also including a fastener 18 for closing the opening 13 into the main compartment 14, and further including a plurality of pockets 25-30 securely and conventionally attached to the bag 11, and also including light-emitting means removably attached to the bag 11. The handbag assembly also includes a mirror 20 securely and conventionally attached to the cover member 16, and further includes a coin pouch 23 securely and conventionally attached to the bag 11 in the side compartment 15 and being closeable with a zipper member 24, and also includes a hook assembly being securely and conventionally attached to one of the walls 12 of the bag 11 in the main compartment 14 for holding keys and mace. The fastening member 17 is essentially a zipper being securely attached and sewn about a perimeter of the side compartment 15 and along a perimeter of the cover member 16. The fastener 18 for closing the opening 13 into the main compartment 14 includes a draw string conventionally disposed about an exterior of one of the walls 12 of the bag 11 near the opening 13 and being adapted to cinch close the opening 13. The handbag assembly further includes an identification card holder 21 securely and conventionally attached to one of the walls 12 of the bag 11 in the side compartment 15 and having a transparent wall 22 to allow an identification card to be visible in the identification card holder 21. The plurality of pockets 25–30 includes a first pocket 25 being securely and conventionally attached to one of the walls 12 of the bag 11 in the main compartment 14 and being adapted to hold a cell phone 46, and also includes a second pocket 26 being securely and conventionally attached to one of the side walls 12 of the bag 11 in the main compartment 14 and being adapted to hold a pager device 47, and further includes a third pocket 27 also being securely and conventionally attached to one of the side walls 12 of the bag 11 in the main compartment 14 and being adapted to hold lipstick 48, and also includes a fourth pocket 28 being securely and conventionally attached to one of the side walls 12 of the bag 11 in the main compartment 14 and having a plurality of separated compartments 31 which are adapted to hold writing instruments 49 and pads of paper, and further includes a fifth pocket 29 being securely and conventionally attached to an exterior of one of the walls 12 of the bag 11 and having a flap portion 32 for closing the fifth pocket 29 and being adapted to hold business cards 51, and also includes a plurality of pocket members 30 being securely and conventionally attached to one of the walls 12 of the bag 11 in the side compartment 15 and being arranged one on top of another in a column and being adapted to hold cards 50 such as credit cards. The light-emitting means includes tubular light-emitting holders 33 each having a side wall 38 and an open end 40, and also includes light-emitting members 34 being disposed in the tubular light-emitting holders 33, and further includes batteries 36 conventionally disposed in the light-emitting holders 33 and being connected with wires to the light-emitting members 34, and also includes on/off switches 35 being movably and conventionally disposed at the open ends 40 of the light-emitting holders 33 and being connected with the wires to the light-emitting members 34 and to the batteries 36 for energizing the light-emitting members 34, and further includes hook and loop fasteners 37 being securely and conventionally attached to an exterior of the side walls 38 of the light-emitting holders 33 and to one of the walls 12 of the bag 11 in the main compartment 14 for removably fastening the light-emitting holders 33 to the bag 11. Each of the light-emitting holders 33 includes a plurality of holes 39 being spaced apart and along a length of and disposed through the side wall 38 thereof with each of the holes 39 being adapted to receive a respective light-emitting member 34 which is extended through the hole 39. The hook assembly includes a loop member 41 securely and conventionally attached to one of the walls 12 of the bag 11 in the main compartment 14, and also includes an eyelet 42 being securely and conventionally attached to the loop member 41, and further includes a hook member 43 being securely and conventionally attached to the eyelet 42 and having a hook 44 and a latch 45 movably attached to the hook 44 for securely holding keys and mace in the main compartment 14.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A lighted and content-organizing carrying case comprising:

a handbag assembly including:

a bag having walls, said walls forming a main compartment, said main compartment having an opening, a side compartment having a cover member pivotally mounted on said walls, a fastening member releasably fastening a portion of a perimeter of said cover member to a portion of a perimeter of said side compartment;

a carrying strap having ends attached to said bag, a fastener for closing said opening into said main compartment;

a plurality of pockets attached to said bag;

light-emitting means removably attached to said bag;

a mirror attached to said cover member;

a coin pouch attached to said bag in side compartment: and a hook assembly attached to one of said walls of said bag in said main compartment, wherein said light-emitting means includes tubular light-emitting holders, each of said holders having a side wall and an open end, and also includes light-emitting members being disposed in said tubular light-emitting holders and further includes hook and loop fasteners being attached to exteriors of said side walls of said light-emitting holders and to said walls of said bag in said main compartment for removably fastening said light-emitting holders to said bag.

2. A lighted and content-organizing carrying case as described in claim 1, wherein said fastener for closing said opening into said main compartment includes a draw string disposed about an exterior of one of said walls of said bag near said opening and being adapted to cinch closed said opening.

3. A lighted and content-organizing carrying case as described in claim 1, wherein said handbag assembly further includes an identification card holder attached to one of said walls of said bag in said side compartment, said identification card holder having a transparent wall to allow an identification card situated in said identification card holder to be visible through said transparent wall.

4. A lighted and content-organizing carrying case as described in claim 1, wherein said plurality of pockets includes a first pocket being attached to one of said walls of said bag in said main compartment and being adapted to hold a cell phone, and also includes a second pocket being attached to one of said walls of said bag in said main compartment and being adapted to hold a pager device, and further includes a third pocket also being attached to one of said walls of said bag in said main compartment and being adapted to hold lipstick, and also includes a fourth pocket being attached to one of said walls of said bag in said main compartment and having a plurality of separated compartments which are adapted to hold writing instruments and pads of paper, and further includes a fifth pocket being attached to an exterior of one of said walls of said bag and having a flap portion for closing said fifth pocket and being adapted to hold business cards, and also includes a plurality of pocket members being attached to one of said walls of said bag in said side compartment and being arranged one on top of another in a column and being adapted to hold cards such as credit cards.

5. A lighted and content-organizing carrying case as described in claim 1, wherein each of said light-emitting holders includes a plurality of holes being spaced apart and along a length of and disposed through said side wall thereof, each of said holes being adapted to receive a respective light-emitting member which is extended through said hole.

6. A lighted and content-organizing carrying case as described in claim 1, wherein said hook assembly includes a loop member attached to one of said walls of said bag in said main compartment, and also includes an eyelet attached to said loop member, and further includes a hook member being attached to said eyelet and having a hook and a latch movably attached to said hook for holding keys and mace in said main compartment.

7. A lighted and content-organizing carrying case as described in claim 1, wherein said fastening member comprises a zipper.

8. A lighted and content-organizing carrying case comprising:

a handbag assembly including:

a bag having walls, said walls forming a main compartment, said main compartment having an opening, a side compartment having a cover member pivotally mounted on said walls, a fastening member releasably fastening a portion of a perimeter of said cover member to a portion of a perimeter of said side compartment:

a carrying strap having ends attached to said bag;

a fastener for closing said opening into said main compartment;

a plurality of pockets attached to said bag;

light-emitting means removably attached to said bag;

a mirror attached to said cover member;

a coin pouch attached to said bag in side compartment; and a hook assembly attached to one of said walls of said bag in said main compartment;

wherein said handbag assembly further includes an identification card holder attached to one of said walls of said bag in said side compartment, said identification card holder having a transparent wall to allow an identification card situated in said identification card holder to be visible through said transparent wall.

9. A lighted and content-organizing carrying case as described in claim 8, wherein said plurality of pockets includes a first pocket being attached to one of said walls of said bag in said main compartment and being adapted to hold a cell phone, and also includes a second pocket being attached to one of said walls of said bag in said main compartment and being adapted to hold a pager device, and further includes a third pocket also being attached to one of said walls of said bag in said main compartment and being adapted to hold lipstick, and also includes a fourth pocket being attached to one of said walls of said bag in said main compartment and having a plurality of separated compartments which are adapted to hold writing instruments and pads of paper, and further includes a fifth pocket being attached to an exterior of one of said walls of said bag and having a flap portion for closing said fifth pocket and being adapted to hold business cards, and also includes a plurality of pocket members being attached to one of said walls of said bag in said side compartment and being arranged one on top of another in a column and being adapted to hold cards such as credit cards.

10. A lighted and content-organizing carrying case as described in claim 8, wherein said light-emitting means includes tubular light-emitting holders, each of said holders having a side wall and an open end, and also includes light-emitting members being disposed in said tubular light-emitting holders and further includes hook and loop fasteners being attached to exteriors of said side walls of said light-emitting holders and to said walls of said bag in said main compartment for removably fastening said light-emitting holders to said bag.

11. A lighted and content-organizing carrying case as described in claim 10, wherein each of said light-emitting holders includes a plurality of holes being spaced apart and along a length of and disposed through said side wall thereof, each of said holes being adapted to receive a respective light-emitting member which is extended through said hole.

12. A lighted and content-organizing carrying case as described in claim 8, wherein said fastener for closing said opening into said main compartment includes a draw string disposed about an exterior of one of said walls of said bag near said opening and being adapted to cinch closed said opening.

13. A lighted and content-organizing carrying case comprising:

a handbag assembly including:

a bag having walls, said walls forming a main compartment, said main compartment having an opening, a side compartment having a cover member pivotally mounted on said walls, a fastening member releasably fastening a portion of a perimeter of said cover member to a portion of a perimeter of said side compartment;

a carrying strap having ends attached to said bag;

a fastener for closing said opening into said main compartment;

a plurality of pockets attached to said bag;

light-emitting means removably attached to said bag;

a mirror attached to said cover member;

a coin pouch attached to said bag in side compartment; and a book assembly attached to one of said walls of said bag in said main compartment;

wherein said hook assembly includes a loop member attached to one of said walls of said bag in said main compartment, and also includes an eyelet attached to said loop member, and further includes a hook member being attached to said eyelet and having a book and a latch movably attached to said hook for holding keys and mace in said main compartment.

14. A lighted and content-organizing carrying case as described in claim 13, wherein said plurality of pockets includes a first pocket being attached to one of said walls of said bag in said main compartment and being adapted to hold a cell phone, and also includes a second pocket being attached to one of said walls of said bag in said main compartment and being adapted to hold a pager device, and further includes a third pocket also being attached to one of said walls of said bag in said main compartment and being adapted to hold lipstick, and also includes a fourth pocket being attached to one of said walls of said bag in said main compartment and having a plurality of separated compartments which are adapted to hold writing instruments and pads of paper, and further includes a fifth pocket being attached to an exterior of one of said walls of said bag and having a flap portion for closing said fifth pocket and being adapted to hold business cards, and also includes a plurality of pocket members being attached to one of said walls of said bag in said side compartment and being arranged one on top of another in a column and being adapted to hold cards such as credit cards.

15. A lighted and content-organizing carrying case as described in claim 13, wherein said light-emitting means includes tubular light-emitting holders, each of said holders having a side wall and an open end, and also includes light-emitting members being disposed in said tubular light-emitting holders and further includes hook and loop fasteners being attached to exteriors of said side walls of said light-emitting holders and to said walls of said bag in said main compartment for removably fastening said light-emitting holders to said bag.

16. A lighted and content-organizing carrying case as described in claim 15, wherein each of said light-emitting holders includes a plurality of holes being spaced apart and along a length of and disposed through said side wall thereof, each of said holes being adapted to receive a respective light-emitting member which is extended through said hole.

17. A lighted and content-organizing carrying case as described in claim 13, wherein said fastener for closing said opening into said main compartment includes a draw string disposed about an exterior of one of said walls of said bag near said opening and being adapted to cinch closed said opening.

* * * * *